US011156045B2

(12) United States Patent
Kellner

(10) Patent No.: US 11,156,045 B2
(45) Date of Patent: Oct. 26, 2021

(54) WIRELINE ADAPTER KIT

(71) Applicant: INNOVEX DOWNHOLE SOLUTIONS, INC., Houston, TX (US)

(72) Inventor: Justin Kellner, Adkins, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 63 days.

(21) Appl. No.: 16/695,347

(22) Filed: Nov. 26, 2019

(65) Prior Publication Data

US 2020/0173242 A1 Jun. 4, 2020

Related U.S. Application Data

(60) Provisional application No. 62/773,368, filed on Nov. 30, 2018.

(51) Int. Cl.

| | |
|---|---|
| ***E21B 23/06*** | (2006.01) |
| ***E21B 33/12*** | (2006.01) |
| ***E21B 23/04*** | (2006.01) |
| ***E21B 23/01*** | (2006.01) |
| ***E21B 33/134*** | (2006.01) |
| *E21B 23/00* | (2006.01) |

(52) U.S. Cl.

CPC ..... *E21B 23/06* (2013.01); *E21B 23/01* (2013.01); *E21B 23/04* (2013.01); *E21B 23/0411* (2020.05); *E21B 33/12* (2013.01); *E21B 33/134* (2013.01); *E21B 23/00* (2013.01)

(58) Field of Classification Search

CPC ..... E21B 17/02; E21B 17/06; E21B 23/00; E21B 23/01; E21B 23/04; E21B 23/0411; E21B 23/06; E21B 33/134

See application file for complete search history.

(56) References Cited

U.S. PATENT DOCUMENTS

| | | | | |
|---|---|---|---|---|
| 2018/0274325 | A1* | 9/2018 | Greenlee | E21B 33/1293 |
| 2020/0149365 | A1* | 5/2020 | Wilson | E21B 29/005 |
| 2020/0157912 | A1* | 5/2020 | Mhaskar | E21B 33/134 |

* cited by examiner

*Primary Examiner* — Tara Schimpf

(74) *Attorney, Agent, or Firm* — MH2 Technology Law Group LLP

(57) ABSTRACT

A downhole tool includes an outer sleeve and an inner sleeve positioned at least partially within the outer sleeve. A setting ring is configured to be positioned at least partially within the inner sleeve. A first fastener is configured to couple the setting ring to a plug. The inner sleeve is configured to pull on the setting ring to actuate the plug from a first state into a second state. The first fastener is configured to break when the plug is in the second state, thereby de-coupling the setting ring from the plug.

26 Claims, 4 Drawing Sheets

WIRELINE ADAPTER KIT

CROSS-REFERENCE TO RELATED APPLICATIONS

This application claims priority to U.S. Provisional Patent Application having Ser. No. 62/773,368, which was filed on Nov. 30, 2018, and is incorporated herein by reference in its entirety.

BACKGROUND

Typically, a frac plug is coupled to a setting tool in the field prior to running the frac plug and the setting tool into the wellbore. This oftentimes includes coupling a first (e.g., inner) portion of the setting tool directly to a mandrel of the frac plug (e.g., via one or more shear screws). Once coupled, the setting tool and the frac plug may be run into the wellbore. The setting tool may exert opposing forces on the frac plug. For example, inner portion of the setting tool may pull upwardly on the mandrel while a second (e.g., outer) portion of the setting tool pushes downwardly to axially-compress one or more components positioned around the mandrel. This axial-compression may cause the one or more components positioned around the mandrel to expand radially-outward and engage a surrounding tubular (e.g., a liner, a casing, a wellbore wall, etc.). This may secure the frac plug in place. Once the frac plug has been set, the opposing forces may be increased, causing the one or more shear screws to shear, thereby de-coupling the setting tool from the frac plug. The setting tool may then be pulled back to the surface.

This method of assembling the setting tool and the frac plug in the field may be complex and lead to faulty couplings. In addition, conventional coupling methods, such as the one described above, may not distribute the forces evenly, which may cause, for example, the mandrel or the shear screws to shear or break too early or too late in the process, leading to a failure to properly set the frac plug.

SUMMARY

A downhole tool includes an outer sleeve and an inner sleeve positioned at least partially within the outer sleeve. A setting ring is configured to be positioned at least partially within the inner sleeve. A first fastener is configured to couple the setting ring to a plug. The inner sleeve is configured to pull on the setting ring to actuate the plug from a first state into a second state. The first fastener is configured to break when the plug is in the second state, thereby de-coupling the setting ring from the plug.

A system for isolating a portion of a wellbore includes a wireline adapter kit and a plug. The wireline adapter kit includes an outer sleeve and an inner sleeve positioned at least partially within the outer sleeve. The wireline adapter kit also includes a setting ring configured to be positioned at least partially within the inner sleeve. The setting ring has a first opening formed radially-therethrough. The wireline adapter kit also includes a fastener. The plug includes a mandrel. The mandrel has a second opening formed at least partially radially-therethrough. The fastener is configured to be inserted at least partially into the first and second openings when the first and second openings are aligned, thereby coupling the setting ring to the mandrel.

A method is also disclosed. The method includes coupling a setting ring to a mandrel of a plug using a fastener. The method also includes coupling the setting ring to an inner sleeve of a wireline adapter kit. The method also includes running the wireline adapter kit and the plug into a wellbore. The method also includes setting the plug using the wireline adapter kit. The method also includes de-coupling the setting ring from the mandrel after the plug is set by causing the fastener to break.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
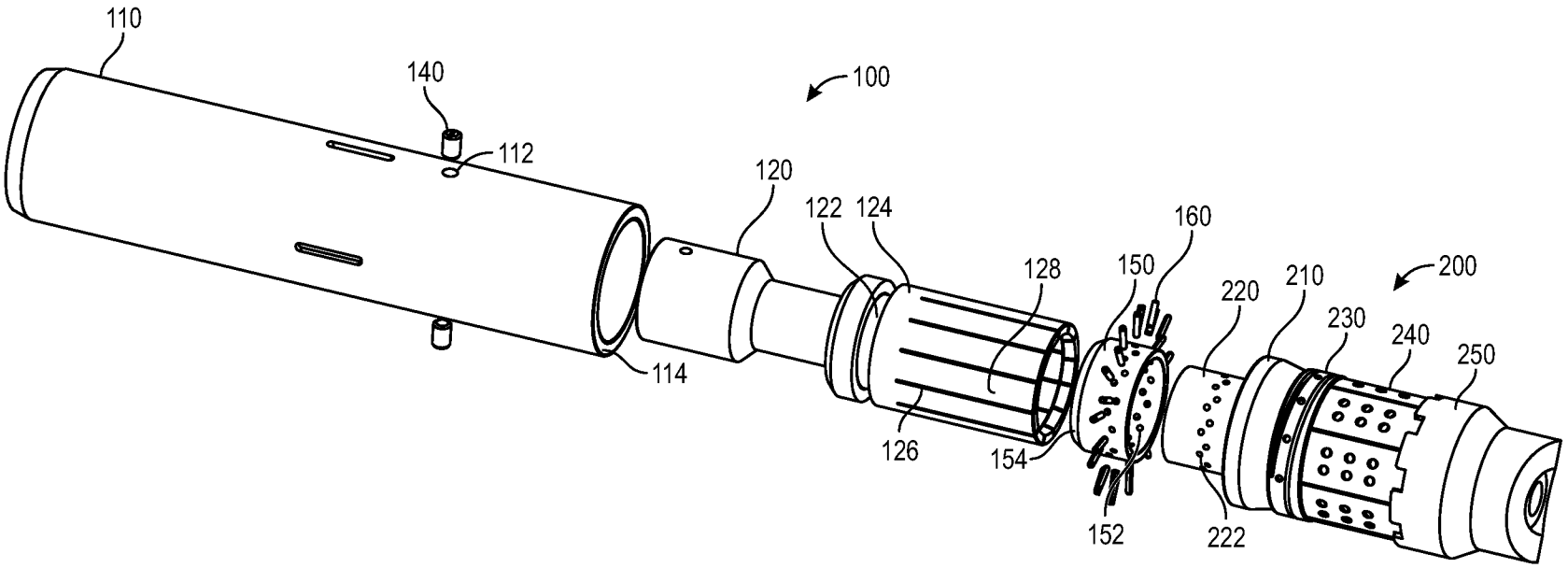
FIG. 1 illustrates an exploded, perspective view of a downhole tool (e.g., wireline adapter kit) and a plug, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, embodiments of the present disclosure provide a downhole tool for setting a plug in a wellbore. The downhole tool may be or include a wireline adapter kit (WLAK). As described in greater detail below, the wireline adapter kit may include an outer sleeve and an inner sleeve. One or more fasteners may be used to couple a setting ring to the plug. The setting ring may then be inserted into and retained within the inner sleeve, thereby coupling the inner sleeve of the wireline adapter kit to the plug.

Turning now to the specific, illustrated embodiments, FIG. 1 illustrates an exploded, perspective view of a downhole tool 100 and a plug 200, according to an embodiment. The downhole tool may be or include a wireline adapter kit (WLAK). The wireline adapter kit 100 may be used to connect the plug 200 to a wireline and to set the plug 200 in a wellbore at a predetermined location. The plug 200 may be or include a frac plug.

The wireline adapter kit 100 may include an outer sleeve 110 and an inner sleeve 120. The outer sleeve 110 may include one or more (e.g., radial) openings 112, and the inner sleeve 120 may include a groove 122. When the wireline adapter kit 100 is assembled, each opening 112 may be aligned with the groove 122. The outer sleeve 110 and the inner sleeve 120 may then be coupled together via one or more first fasteners 140 that are inserted at least partially into openings 112 and the groove 122. The first fasteners 140 may be or include screws, which may be configured to avoid the wireline adapter kit 100 setting the plug 200 prematurely, as will be explained in greater detail below.

A lower axial end 114 of the outer sleeve 110 may be configured to contact an upper axial end of the plug 200. More particularly, the lower axial end 114 of the outer sleeve 110 may contact a load ring 210 (or other component) that is positioned proximate to the upper axial end of the plug 200.

A collet 124 on a lower axial end of the inner sleeve 120 may be configured to be (e.g., indirectly) coupled to an upper axial end of a mandrel 220 of the plug 200. More particularly, the collet 124 of the inner sleeve 120 may be configured to be coupled to the upper axial end of the mandrel 220 via a setting ring 150 and one or more second fasteners 160. The collet 124 may include a plurality of axially-extending slots 126 that are circumferentially-offset from one another. The collet 124 may also include a plurality of axially-extending fingers 128, with each finger 128 positioned circumferentially-between two adjacent slots 126.

The setting ring 150 may be annular and configured to fit at least partially over and/or around the upper axial end of the mandrel 220 of the plug 200. The setting ring 150 may include one or more (e.g., radial) openings 152 formed therethrough. As shown, the setting ring 150 may include a plurality of openings 152. The openings 152 may be circumferentially-offset from one another and/or axially-offset from one another with respect to a central longitudinal axis through the setting ring 150.

The upper axial end of the mandrel 220 may also include one or more (e.g., radial) openings 222 formed therein. As shown, the upper axial end of the mandrel 220 may include a plurality of openings 222. The openings 222 may be circumferentially-offset from one another and/or axially-offset from one another with respect to a central longitudinal axis through the mandrel 220. The number, positioning, and/or orientation of the openings 152, 222 may be varied to distribute the forces exerted during the setting of the plug 200 and, e.g., protect the integrity of the mandrel 220.

When the setting ring 150 is positioned over/around the upper axial end of the mandrel 220, the openings 152 may be aligned with the openings 222. The setting ring 150 may be coupled to the upper axial end of the mandrel 220 via the second fasteners 160. More particularly, a second fastener 160 may be inserted radially into each set/pair of aligned openings 152, 222. The second fasteners 160 may be or include shearable members, e.g., spring pins. The second fasteners 160 may be held in place, for example, via a friction fit. When inserted into the openings 152, 222, the second fasteners 160 may prevent axial and/or rotational movement between the setting ring 150 and the mandrel 220.

In addition, the setting ring 150 may be configured to fit at least partially within the collet 124, specifically, within the fingers 128. An axial end of the setting ring 150 may include a tapered surface 154 to facilitate insertion of the setting ring 150 into the collet 124. Once the setting ring 150 is received into the collet 124, the fingers 128 may engage a square shoulder on the downhole side of the setting ring 150, thereby preventing the setting ring 150 from being axially displaced from within the collet 124, as will be explained in greater detail below.

Figure 2:
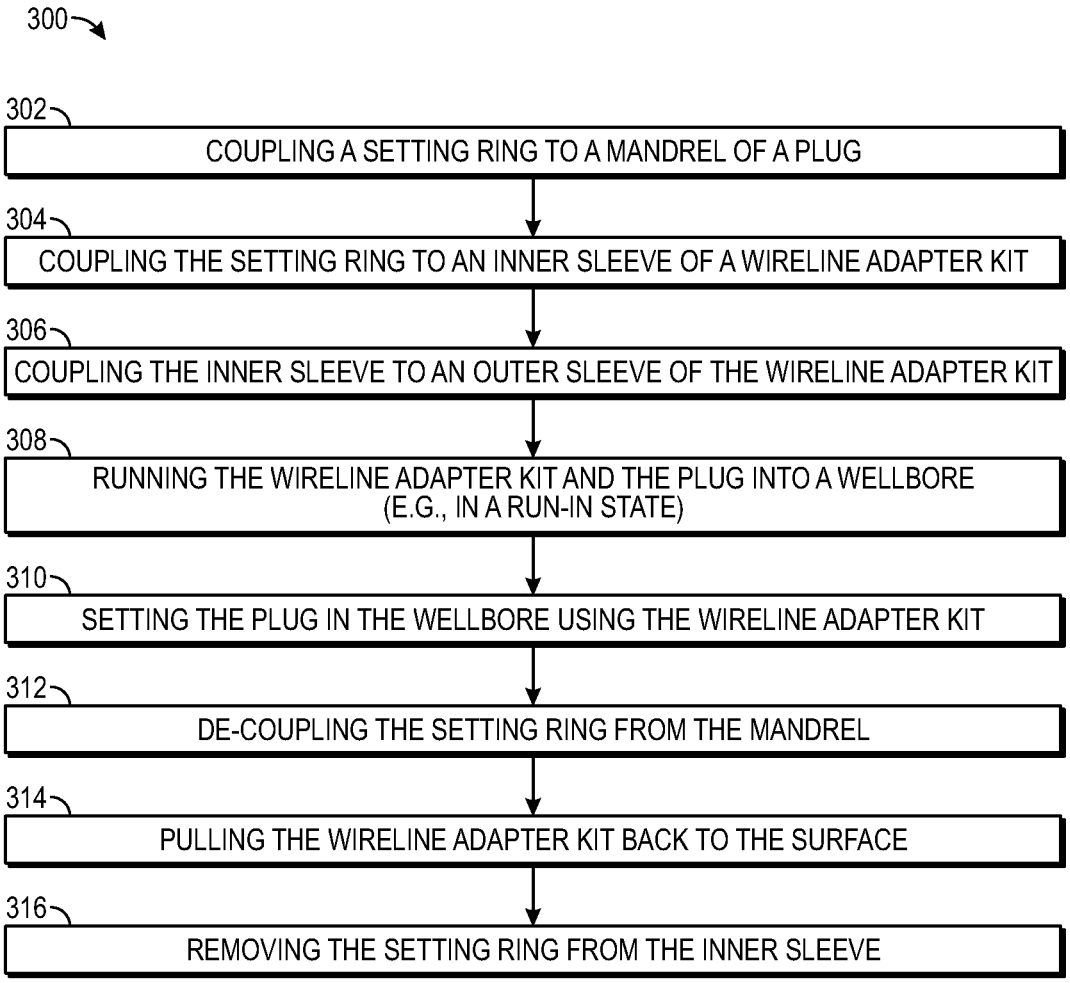
FIG. 2 illustrates a flowchart of a method for setting the plug using the wireline adapter kit, according to an embodiment.

FIG. 2 illustrates a flowchart of a method 300 for setting the plug 200 using the wireline adapter kit 100, according to an embodiment. The method 300 may include coupling the setting ring 150 to the mandrel 220 of the plug 200, as at 302. As discussed above, this may include moving the setting ring 150 axially with respect to the mandrel 220 until the setting ring 150 is positioned at least partially over/around the upper end of the mandrel 220. In at least one embodiment, the setting ring 150 may be rotated with respect to the mandrel 220 until the openings 152 in the setting ring 150 are aligned with the openings 222 in the mandrel 220. The fasteners 160 may then be inserted into the aligned openings 152, 222 to couple the setting ring 150 to the mandrel 220.

The method 300 may also include coupling the setting ring 150 to the inner sleeve 120 of the wireline adapter kit 100, as at 304. Coupling the setting ring 150 to the inner sleeve 120 may include moving the setting ring 150 axially with respect to the inner sleeve 120 until the setting ring 150 is positioned at least partially within the inner sleeve 120 (e.g., within the collet 124). The tapered surface 154 may facilitate insertion of the setting ring 150 into the collet 124. The fingers 128 of the collet 124 may be configured to bend or flex (e.g., radially-outward) to accommodate the insertion of the setting ring 150. Actions 302 and 304 may, at least partially, place the wireline adapter kit 100 and the plug 200 in a first (e.g., run-in) state.

Figure 3:
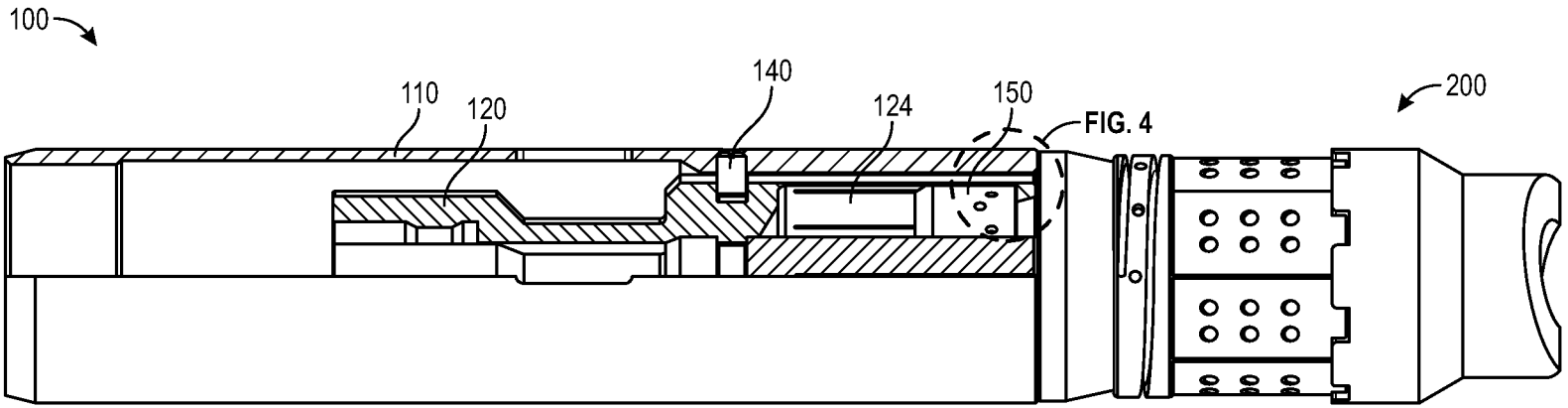
FIG. 3 illustrates a cross-sectional side view of the wireline adapter kit and the plug in a first (e.g., run-in) state, according to an embodiment.
Figure 4:
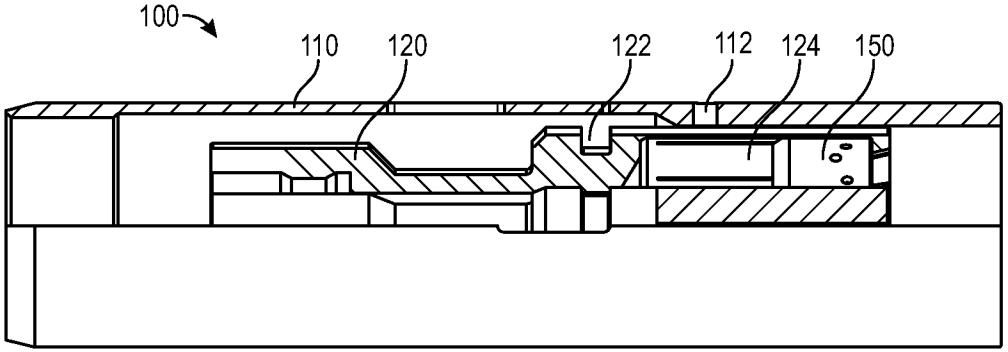
FIG. 4 illustrates an enlarged cross-sectional side view of a portion of the wireline adapter kit and the plug from FIG. 3, according to an embodiment.
Figure 4:
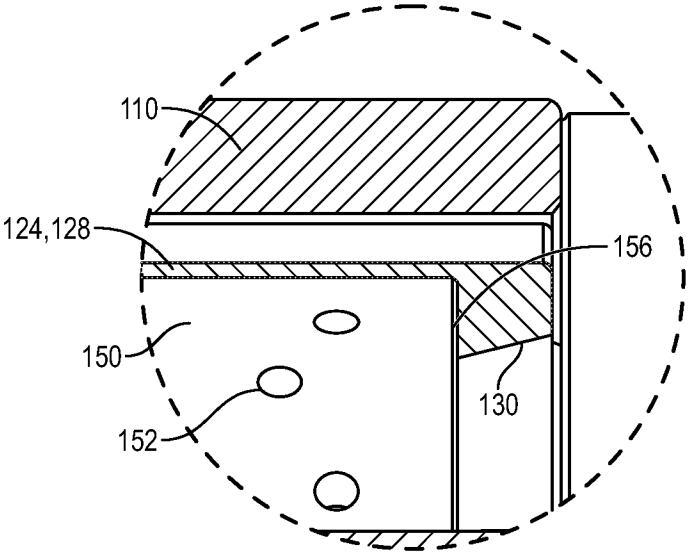

FIG. 3 illustrates a cross-sectional side view of the wireline adapter kit 100 and the plug 200 in the first (e.g., run-in) state, and FIG. 4 illustrates an enlarged portion of FIG. 3, according to an embodiment. As shown in FIGS. 3 and 4, the fingers 128 of the collet 124 may include radially-inwardly extending protrusions (also referred to as "detents") 130. When the setting ring 150 is positioned within the collet 124, the protrusions 130 may axially-abut a square (radially-extending) shoulder 156 on the downhole side of the setting ring 150, preventing the setting ring 150 from being axially withdrawn from the collet 124.

The method 300 may also include coupling the inner sleeve 120 to the outer sleeve 110 of the wireline adapter kit 100, as at 306. This may include moving the inner sleeve 120 axially, and/or rotating the inner sleeve 120, with respect to the outer sleeve 110, until the groove 122 in the inner sleeve 120 is aligned with the openings 112 in the outer sleeve 110. The fasteners 140 may then be inserted into the aligned openings 112 and groove 122 to couple the inner sleeve 120 to the outer sleeve 110. This is also shown in FIG. 3. When the setting ring 150 is coupled to the mandrel 220, the setting ring 150 is coupled to the inner sleeve 120, and/or the inner sleeve 120 is coupled to the outer sleeve 110, the wireline adapter kit 100 and the plug 200 are in the first (e.g., run-in state), as shown in FIG. 3.

The method 300 may also include running the wireline adapter kit 100 and the plug 200 into a wellbore (e.g., in the run-in state), as at 308. When in the desired location in the wellbore, the method 300 may also include setting the plug 200 in the wellbore using the wireline adapter kit 100, as at 310. This may include applying/exerting opposing forces on the plug 200 using the wireline adapter kit 100. More particularly, the outer sleeve 110 may push downward (to the right in the Figures) on the load ring 210 (or other component) while the inner sleeve 120 may pull upward (to the left in the Figures) on the mandrel 220.

Figure 5:
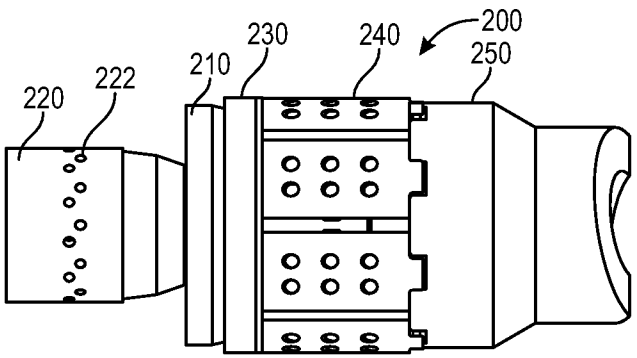
FIG. 5 illustrates a cross-sectional side view of the wireline adapter kit and the plug in a second (e.g., set) state, according to an embodiment.

This may cause the load ring 210 (or other component) to move downward with respect to the mandrel 220, thereby axially-compressing a setting assembly of the plug 200 between the load ring 210 (or other component) and a shoulder or shoe 250 proximate to a lower end of the plug 200. The setting assembly may include one or more sealing elements 230 and one or more slips 240 that are positioned around the mandrel 220 between the load ring 210 and the shoulder or shoe 250. The axial-compression of the sealing elements 230 and slips 240 may cause the sealing elements 230 and the slips 240 to expand radially-outward and engage a surrounding tubular (e.g., a liner, a casing, a wellbore wall, etc.) as the plug 200 is set in the wellbore. This is shown in FIG. 5, which illustrates a cross-sectional side view of the wireline adapter kit 100 and the plug 200 in a second (e.g., set) state, according to an embodiment.

The method 300 may also include de-coupling the setting ring 150 from the mandrel 220, as at 312. This may include increasing the opposing forces applied/exerted on the plug 200 using the wireline adapter kit 100. When the opposing forces exceed a predetermined amount, the fasteners 160 may break, allowing the setting ring 150 to de-couple from the mandrel 220. The setting ring 150 may remain positioned within the inner sleeve 120 (e.g., within the collet 124 due to the protrusions 130 engaging the setting ring 150). This is also shown in FIG. 5. The number and size of the fasteners 160 may be selected such that the setting ring 150 becomes decoupled from the mandrel 220 prior to the mandrel 220 yielding (e.g., the fasteners 160 shear prior to ripping up through the mandrel 220). Because at least the number of fasteners 160 may be modified (e.g., at least some of the openings 152 may be empty), the setting force may be predetermined and reliably implemented in the field.

The method 300 may also include pulling the wireline adapter kit 100 back to the surface, as at 314. The plug 200 may remain set in the wellbore, but the setting ring 150 may be entrained within the collet 124. The method 300 may thus include removing the setting ring 150 from the collet 124 of the inner sleeve 120, as at 316. The setting ring 150 may be removed by using a tool to radially-expand the collet 124 such that the protrusions 130 no longer axially-abut the setting ring 150. The setting ring 150 may then be pulled axially-out of the collet 124. In another embodiment, the setting ring 150 may have a helical groove which may receive the protrusions 130, and thus the setting ring 150 may be screwed out of the collet 124 to de-couple the setting ring 150 from the collet 124.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

an outer sleeve;

an inner sleeve positioned at least partially within the outer sleeve, wherein the inner sleeve comprises an axially-extending slot;

a setting ring configured to be positioned at least partially within the inner sleeve; and a first fastener configured to couple the setting ring to a plug, wherein the first fastener extends radially through the axially-extending slot and into the setting ring, wherein the inner sleeve is configured to pull on the setting ring to actuate the plug from a first state into a second state, and wherein the first fastener is configured to break when the plug is in the second state, thereby de-coupling the setting ring from the plug.

2. The downhole tool of claim 1, wherein the setting ring has a first opening formed radially-therethrough, and the first fastener is configured to be inserted at least partially into the first opening.

3. The downhole tool of claim 2, wherein the setting ring has a second opening formed radially-therethrough, wherein the second opening is circumferentially-offset from the first opening with respect to a central longitudinal axis through the setting ring, and wherein the downhole tool further comprises a second fastener configured to be inserted at least partially into the second opening.

4. The downhole tool of claim 3, wherein the second opening is axially-offset from the first opening with respect to the central longitudinal axis through the setting ring.

5. The downhole tool of claim 1, wherein the first fastener is configured to withstand a first force that is used to set the plug, and to break in response to a second force, thereby de-coupling the setting ring from the plug, wherein the second force occurs after the first force and is greater than the first force.

6. The downhole tool of claim 5, wherein the first force and the second force are less than a force that would cause the plug to yield.

7. The downhole tool of claim 1, wherein an axial end of the setting ring comprises a tapered surface to facilitate insertion of the setting ring into the inner sleeve.

8. The downhole tool of claim 1, wherein the inner sleeve comprises an axially-extending finger, and wherein the finger is configured to radially-expand to facilitate insertion of the setting ring into the inner sleeve.

9. The downhole tool of claim 8, wherein the finger comprises an inwardly-extending protrusion that axially-abuts the setting ring and prevents the setting ring from being withdrawn from the inner sleeve.

10. The downhole tool of claim 1, wherein the first fastener is configured to slide axially-through the axially-extending slot as the setting ring is inserted axially into the inner sleeve.

11. The downhole tool of claim 1, wherein the inner sleeve and the setting ring are positioned around the plug.

12. The downhole tool of claim 1, wherein the inner sleeve and the setting ring are not positioned within the plug.

13. A system for isolating a portion of a wellbore, comprising:

a wireline adapter kit comprising:

an outer sleeve;

an inner sleeve positioned at least partially within the outer sleeve;

a first fastener configured to couple the outer sleeve to the inner sleeve;

a setting ring configured to be positioned at least partially within the inner sleeve, wherein the setting ring has a first opening formed radially-therethrough; and a second fastener; and a plug comprising a mandrel, wherein the mandrel has a second opening formed at least partially radially-therethrough, wherein the second fastener is configured to be inserted at least partially into the first and second openings when the first and second openings are aligned, thereby coupling the setting ring to the mandrel, wherein the first fastener is configured to break in response to a first force, wherein the plug is configured to be set in response to a second force, and wherein the second fastener is configured to break in response to a third force.

14. The system of claim 13, wherein the second fastener is configured to withstand the second force that is used to set the plug, and to break in response to the third force, thereby de-coupling the setting ring from the mandrel, wherein the third force occurs after the second force and is greater than the second force.

15. The system of claim 14, wherein the second force and the third force are less than a force that would cause the mandrel to yield.

16. The system of claim 15, wherein an axial end of the setting ring comprises a tapered surface to facilitate insertion of the setting ring into the inner sleeve.

17. The system of claim 16, wherein the inner sleeve comprises an axially-extending slot and an axially-extending finger, and wherein the finger is configured to radially-expand to facilitate insertion of the setting ring into the inner sleeve.

18. The system of claim 17, wherein the finger comprises an inwardly-extending protrusion that axially-abuts the setting ring and prevents the setting ring from being withdrawn from the inner sleeve.

19. The system of claim 13, wherein the inner sleeve comprises an axially-extending slot, and wherein the second fastener extends radially through the axially-extending slot and into the setting ring.

20. The system of claim 13, wherein the second force occurs after the first force and before the third force.

21. The system of claim 13, wherein the first force, the second force, and the third force are values of a setting force applied by the wireline adapter kit.

22. A method, comprising:

coupling a setting ring to a mandrel of a plug using a fastener;

coupling the setting ring to an inner sleeve of a wireline adapter kit, wherein the inner sleeve comprises an axially-extending slot, and wherein the fastener extends radially through the axially-extending slot and into the setting ring;

running the wireline adapter kit and the plug into a wellbore;

setting the plug using the wireline adapter kit; and de-coupling the setting ring from the mandrel after the plug is set by causing the fastener to break.

23. The method of claim 22, wherein coupling the setting ring to the mandrel comprises inserting the fastener into a first opening in the setting ring, and into a second opening in the mandrel, and wherein first and second openings are aligned.

24. The method of claim 22, wherein coupling the setting ring to the inner sleeve comprises inserting the setting ring axially into the inner sleeve, and wherein the inner sleeve comprises an inwardly-extending protrusion that axially-abuts the setting ring and prevents the setting ring from being withdrawn from the inner sleeve.

25. The method of claim 22, wherein the setting ring remains within the inner sleeve after the setting ring is de-coupled from the mandrel.

26. The method of claim 22, further comprising pulling the wireline adapter kit and the setting ring back to the surface while the plug remains set in the wellbore.

* * * * *